US005360966A

United States Patent [19]

Noda et al.

[11] Patent Number: 5,360,966

[45] Date of Patent: Nov. 1, 1994

[54] MICROWAVE OVEN WITH TEMPERATURE FLUCTUATION DETECTION

[75] Inventors: Tomimitsu Noda, Gifu; Hisao Karino, Aichi; Shinsuke Sato, Yokohama, all of Japan

[73] Assignee: Kabushiki Kaisha Toshiba, Kanagawa, Japan

[21] Appl. No.: 95,265

[22] Filed: Jul. 21, 1993

Related U.S. Application Data

[63] Continuation of Ser. No. 672,854, Mar. 20, 1991, abandoned.

[30] Foreign Application Priority Data

| | | | |
|---|---|---|---|
| Mar. 30, 1990 | [JP] | Japan | 2-85727 |
| Apr. 27, 1990 | [JP] | Japan | 2-111988 |
| Apr. 27, 1990 | [JP] | Japan | 2-111989 |
| Apr. 27, 1990 | [JP] | Japan | 2-111990 |
| Apr. 27, 1990 | [JP] | Japan | 2-114909 |

[51] Int. Cl.[5] ..... H05B 6/68

[52] U.S. Cl. ..... 219/710; 219/494; 219/716; 374/149; 99/325

[58] Field of Search ..... 219/10.55 B, 10.55 R, 219/10.55 E, 494, 510, 710, 711, 712, 667, 716; 99/325, DIG. 14, 451; 374/149, 102

[56] References Cited

U.S. PATENT DOCUMENTS

| | | | |
|---|---|---|---|
| 4,316,068 | 2/1982 | Tanabe | 219/10.55 B |
| 4,345,134 | 8/1982 | Tanaka et al. | 219/10.55 B |
| 4,415,790 | 11/1983 | Diesch et al. | 219/10.55 B |
| 4,426,572 | 1/1984 | Tachikawa et al. | 219/10.55 B |
| 4,481,394 | 11/1984 | Tanabe | 219/10.55 B |
| 4,506,127 | 3/1985 | Satoh | 219/10.55 B |
| 4,520,250 | 5/1985 | Ishihara et al. | 219/10.55 B |
| 4,553,011 | 11/1985 | Nakata et al. | 219/10.55 B |
| 4,890,502 | 1/1990 | Oh | 219/10.55 B |
| 4,918,276 | 4/1990 | Oh | 219/10.55 M |
| 4,970,359 | 11/1990 | Oh | 219/10.55 B |
| 4,996,403 | 2/1991 | White | 219/10.55 B |

FOREIGN PATENT DOCUMENTS

| | | | |
|---|---|---|---|
| 0198430A3 | 10/1986 | European Pat. Off. | H05B 6/68 |
| 0353691A3 | 2/1990 | European Pat. Off. | H05B 6/68 |
| 0394010A3 | 10/1990 | European Pat. Off. | H05B 6/68 |
| 2171223A | 8/1986 | United Kingdom | H05B 6/68 |
| 2204427A | 11/1988 | United Kingdom | H05B 6/68 |

OTHER PUBLICATIONS

Patent Abstracts of Japan, vol. 13, No. 439 (E-827), Oct. 3, 1989 & JP-A-11 67 984 (Matsushita Electric Industrail Co.) Jun. 3, 1989.

Patent Abstracts of Japan, vol. 8, No. 248 (P-313), Nov. 14, 1984 & JP-a-59 120 948 (Sharp K.K.) Jun. 12, 1984.

*Primary Examiner*—Philip H. Leung

*Attorney, Agent, or Firm*—Limbach & Limbach

[57] ABSTRACT

A microwave oven includes a heating chamber in which food to be cooked is contained, a magnetron for range-heating the food contained in the heating chamber, a temperature sensor for sensing the temperature of an atmosphere containing hot air emanating from the food being range-heated in the heating chamber, and a controller for controlling an operation of the magnetron based on fluctuations of the temperatures sensed by the temperature sensor.

8 Claims, 15 Drawing Sheets

MICROWAVE OVEN WITH TEMPERATURE FLUCTUATION DETECTION

This is a continuation of co-pending application No. 07/672,854, filed on Mar. 20, 1991, now abandoned.

BACKGROUND OF THE INVENTION

This invention relates to a microwave oven automatically performing a range heating, and more particularly to control of a magnetron and a heater employed in such a microwave oven.

In conventional microwave ovens, a humidity sensor is provided for sensing moisture or water vapor emanating from food being range cooked or a gas sensor is provided for sensing gas components such as alcohol. A microcomputer operates to control the operation of a magnetron and particularly, the time when the heating operation is completed, based on the results of the sensing of the humidity sensor or the gas sensor.

Japanese Laid-open Patent Application No. 61-269890 discloses an arrangement that sound waves emanating from the food boiling are sensed by a microphone and the sensing result is utilized for controlling the magnetron and this arrangement has recently been practiced.

In the arrangement in which the humidity sensor is employed, oil or melted fat contained in smoke given out from the food being cooked adheres to the surface of the humidity sensor, which lowers the sensitivity of the humidity sensor. Thus, the humidity sensor has a disadvantage in the operational reliability. In order to overcome this disadvantage, the humidity sensor is periodically heated by a heater so that stains are periodically removed from the humidity sensor surface. This improvement, however, increases the complexity of the circuit arrangement and the production cost.

In the arrangement employing the gas sensor, the temperature of the gas sensor needs to be usually maintained at about 300° C., which also brings about the complexity of the circuit arrangement and high production cost.

On the other hand, in the case of sensing the sound waves produced from the food being cooked by the microphone, the sensing result is influenced by the motor vibration, external noise and the like. Consequently, the operational reliability is also in the low level.

SUMMARY OF THE INVENTION

Therefore, an object of the present invention is to provide a heating appliance wherein the operation thereof can be improved by improving the reliability of the heating control operation and the arrangement for the heating control operation can be simplified and cost effective.

The present invention provides a microwave oven comprising a heating chamber in which food to be cooked in contained, a magetron for range-heating the food contained in the heating chamber, temperature sensing means for sensing the temperature of an atmosphere containing hot air emanating from the food being range-heated in the heating chamber, thereby generating a temperature signal, temperature fluctuation detecting means connected to the temperature sensing means for receiving the temperature signal from the temperature sensing means, the temperature fluctuation detecting means generating a temperature fluctuation signal when detecting a temperature fluctuation in which the temperature sensed by the temperature sensing means rises and falls for a short period of time, and control means connected to the temperature fluctuation detecting means for controlling an operation of the magnetron in response to the temperature fluctuation signal.

The temperature of the atmosphere containing hot air emanating from the food being cooked is sensed by the temperature sensing means during the range heating. An amount of hot air produced from the food is increased with progress of the cooking or raise in the food temperature. Thereafter, a large amount of hot air containing vapor is produced from the food when the temperature of the food is raised sufficiently. Consequently, the fluctuations in the temperature of the hot air around the temperature sensing means is increased, which also increases the fluctuations in the temperature sensed by the temperature sensing means. Based on the fluctuations of the temperature sensed by the temperature sensing means, the control means operates to control the magnetron so that the automatic cooking is performed.

It is preferable that the temperature sensing means comprise a thermistor. Since the thermistor is conventionally cost effective and reliable in operation, improvement of the reliability of the temperature sensing means and reduction of the production cost can be achieved.

The above-described microwave oven may further comprise a heater for heating the food contained in the heating chamber. When the control means is arranged so as to control energization of the heater based on the temperature sensed by the temperature sensing means, a single temperature sensing means can be utilized both for the range-heating control and the oven cooking control.

The atmospheric temperature in the heating chamber is high immediately after completion of the previous heating. When the range-heating is initiated in such a condition, the amplitude of the fluctuations in the temperature of the atmosphere around the temperature sensing means becomes small such that it is difficult to detect the temperature fluctuations, resulting in failure in the automatic cooking.

To overcome the above-described disadvantage, the invention provides a modified form wherein the heating appliance further comprises a cooling fan ventilating the heating chamber. The cooling fan is continuously operated until the temperature sensed by the temperature sensing means is decreased below a preselected value after completion of the previous heating. Consequently, since the atmospheric temperature in the heating chamber can be lowered by way of the forced air cooling, the period of the high temperature condition immediately after completion of the previous heating, in which period it is difficult to detect the temperature fluctuations, can be shortened. Consequently, the microwave oven can rapidly recover the condition for the automatic cooking after completion of the previous heating.

In the case where the control means is arranged not to energize the magnetron when the temperature sensed by the temperature sensing means is at a preselected value as above the preselected value after completion of the previous heating, the range cooking is prevented from starting even when a user actuates switches to start the range heating in the condition that it is difficult to detect the temperature fluctuations immediately after completion of the previous heating. Consequently, the automatic cooking can be prevented from failing, Furthermore, alarm means may be provided for warning that the magnetron is not energized when the temperature sensed by the temperature sensing means is above the preselected value after completion of the heating.

The invention provides another modified form wherein the microwave oven further comprises temperature fluctuation in response to the temperature signal from the temperature sensing means and the temperature fluctuation signal from the temperature fluctuation detecting means. The magnetron is controlled on the basis of either the temperature signal generated by the temperature sensing means or the temperature fluctuation signal generated by the temperature fluctuation detecting means.

In the above-described arrangement, the temperature fluctuations are detected by the temperature fluctuation detecting means during the usual range heating. The magnetron is controlled based on the temperature fluctuation signal generated by the temperature fluctuation detecting means, thereby executing the automatic cooking.

On the other hand, it is desirable that the range heating be interrupted before occurrence of the temperature fluctuations when rice is re-warmed by the range heating, for example. In this case, the magnetron is controlled based on the temperature signal from the temperature sensing means , thereby executing the automatic cooking. Consequently, the range heating can be interrupted before the occurrence of the temperature fluctuations.

The temperature sensing means may comprise a thermistor. In this case, the reliability of the temperature sensing means can be improved, the production cost thereof can be reduced and the arrangement therefor can be simplified.

Furthermore, the temperature sensing means may comprise a silicon diode. Influences of variations in the dc power supply voltage applied to the silicon diode can be reduced by utilizing the negative temperature dependency of the forward voltage drop of the silicon diode, thereby preventing the reduction of the temperature sensing accuracy due to the dc power supply voltage variations.

The temperature sensing means may further be arranged into a bridge circuit comprising a thermistor sensing the temperature of the atmosphere containing hot air emanating from the food being range-heated and three resistances. Since the variations in the dc power supply voltage applied to the thermistor can be offset, the temperature sensing accuracy can be prevented from being reduced because of the variations in the dc power supply voltage.

Furthermore, the temperature sensing means may comprise a first temperature sensing element sensing the temperature of the atmosphere containing hot air emanating from the food being cooked and a second temperature sensing element sensing the temperature of an atmosphere outside the appliance. The magnetron is controlled based on the temperature fluctuations obtained from the difference between levels of temperature signals generated by the first and second temperature sensing elements respectively. Consequently, since the temperature fluctuations are based on the difference between the levels of the temperature signals generated by the respective elements, the temperature variations can be offset even if the temperature varies to a large extent, thereby preventing the reduction in the temperature sensing accuracy.

A power supply voltage varies when the working conditions of loads such as the magnetron supplied with an electrical power from a power supply are changed at the time of heating initiation or with progress of the heating thereafter, which causes variations in the level of the output signal of the temperature sensing means. Consequently, the signal level variations at the time of the changing of the working conditions of the loads may be mistaken for the temperature fluctuations.

To solve the above-described problem, the invention provides an arrangement that the control based on the temperature fluctuations is interrupted when the working conditions of the loads such as the magnetron, heater and motor are changed and an interruption of the control operation based on the temperature fluctuations is continued for a predetermined period from the change of the working conditions of the loads. Consequently, occurrence of mistaken detection of the temperature fluctuations due to power supply voltage variations can be prevented when the load working conditions are changed.

The invention provides further another modified form wherein the temperature sensing means comprises a first temperature sensing element sensing the temperature of the atmosphere containing hot air emanating from the food being range-heated and a second temperature sensing element having a thermal responsibility different from that of the first temperature sensing element and sensing the temperature of the atmosphere containing the hot air emanating from the food being range-heated. The operation of the magnetron is controlled based on temperature fluctuations obtained from the difference between levels of temperature signals generated by the first and second temperature sensing elements respectively.

The temperature fluctuations are detected based on the difference between the levels of the temperature signals generated by the first and second temperature sensing elements having different thermal responsibility from each other. Even when the temperature of the atmosphere around the temperature sensing elements varies to a large extent, the variations can be offset. Consequently, the temperature sensing accuracy can be prevented from being lowered by such temperature variations.

The second temperature sensing element may be covered by a cover so as to have the thermal responsibility different from that of the first temperature sensing element.

In further another modified form of the present invention, a low-frequency component blocking circuit is connected to the temperature sensing means for receiving the temperature signal, thereby preventing low frequency components contained in the temperature signal generated by the temperature sensing means from passing therethrough and allowing and allowing alternating current components to pass therethrough. An amplifier circuit is connected to the low-frequency component blocking circuit for amplifying the alternating current components or temperature fluctuation components of the temperature signal having passed through the low-frequency component blocking circuit. A comparator circuit is connected to the amplifier circuit for receiving the temperature fluctuation component amplified by the amplifier circuit and generates a heating interruption signal when the fluctuation component exceeds a predetermined value. Control means responds to the heating interruption signal produced from the comparator circuit such that the operation of the magnetron is interrupted.

Other objects of the present invention will become obvious upon understanding of the illustrative embodiments about to be described or will be indicated in the appended claims. Various advantages not referred to herein will occur to one skilled in the art upon employment of the invention in practice.

Figure 1:
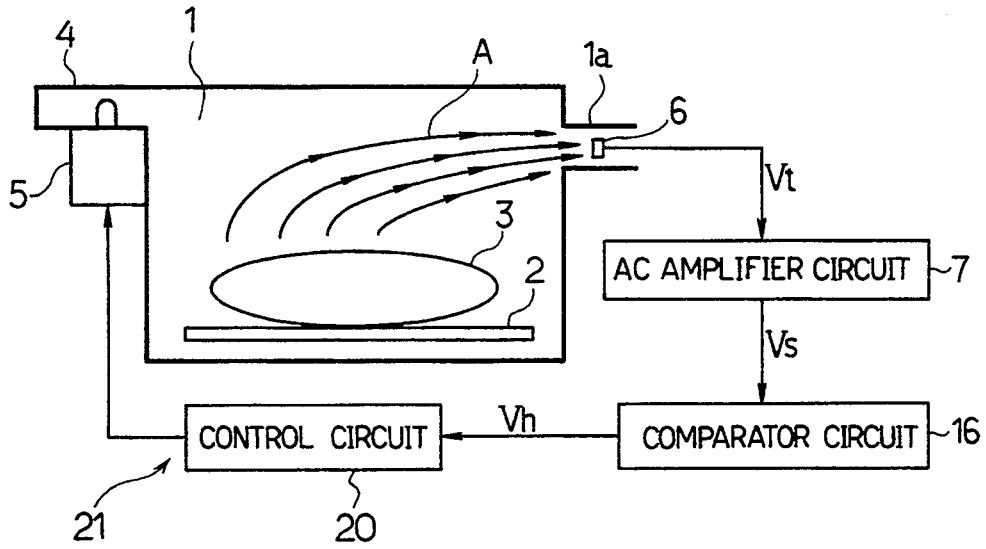
FIG. 1 schematically illustrates an overall arrangement of a microwave oven of a first embodiment in accordance with the present invention.
Figure 2:
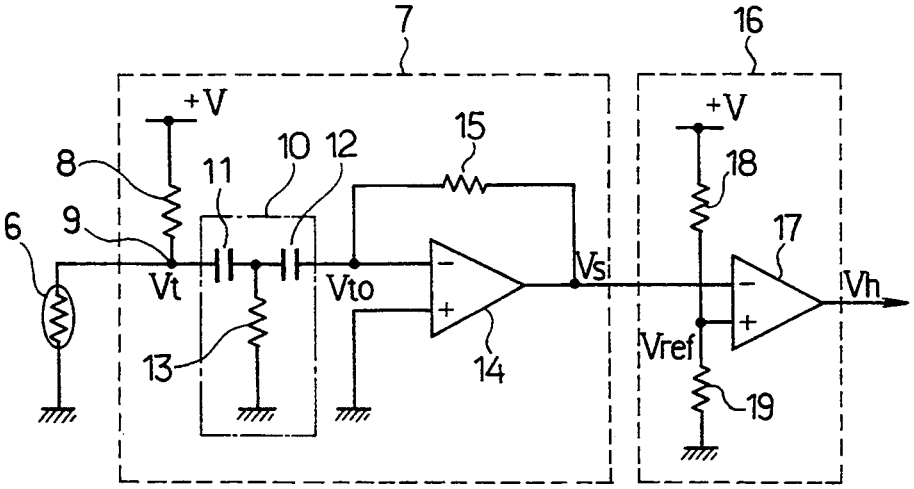
Figure 3:
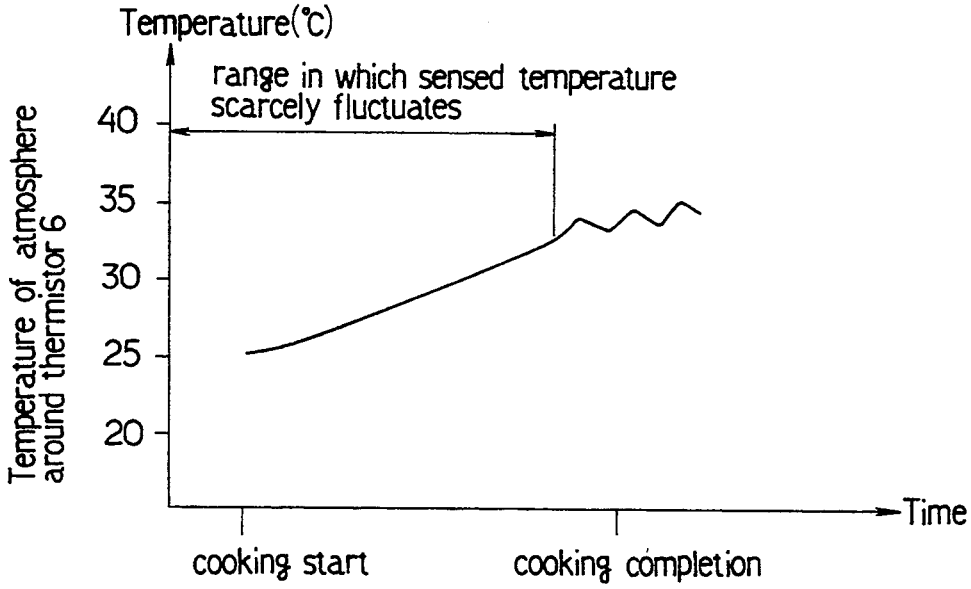
Figure 4:
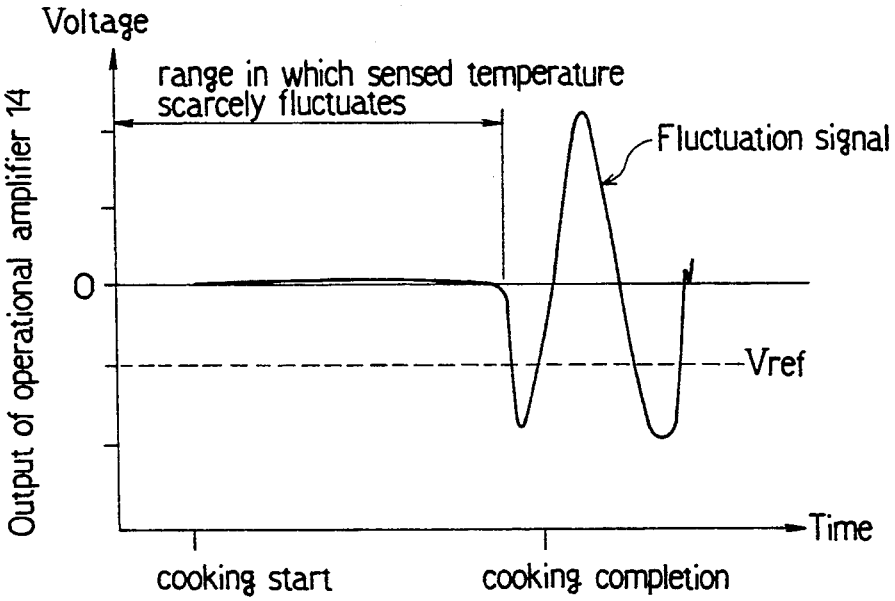
Figure 5:
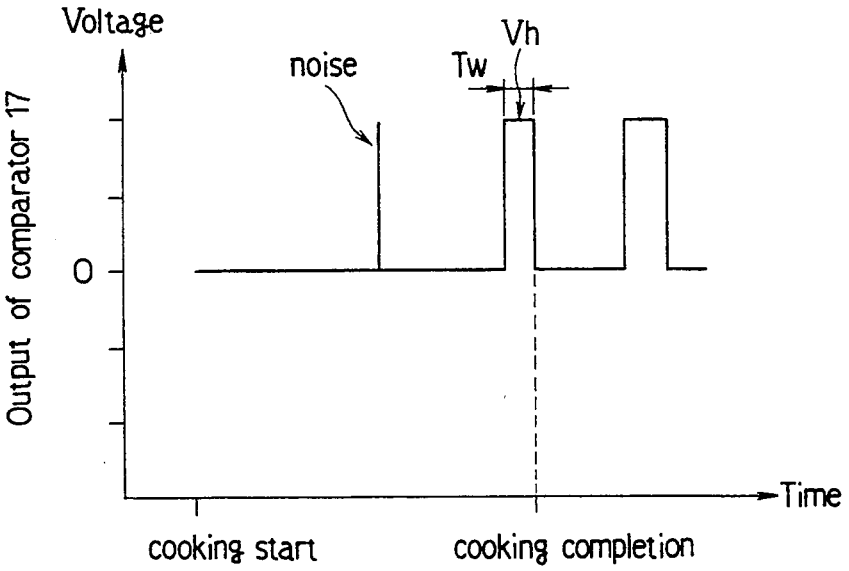
Figure 7:
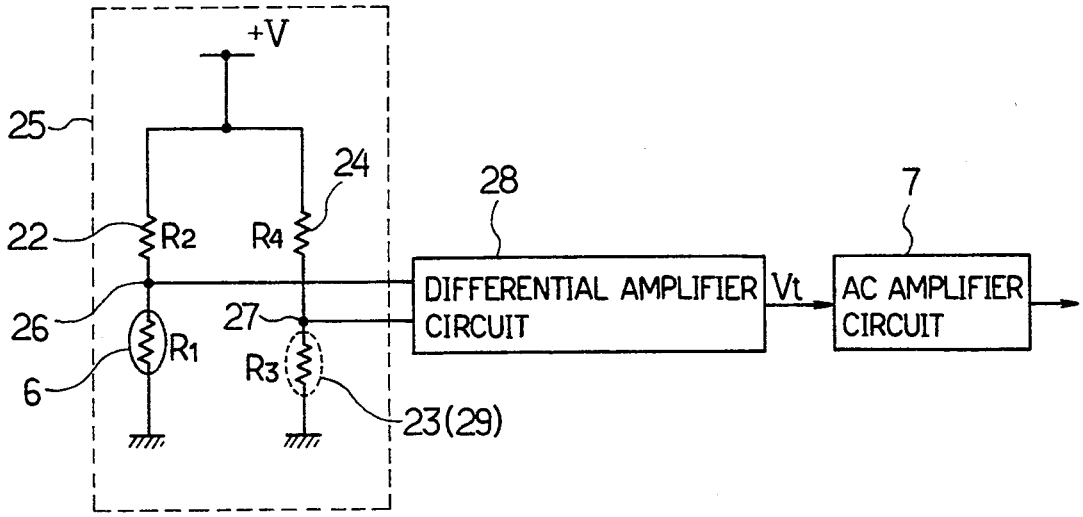
Figure 12:
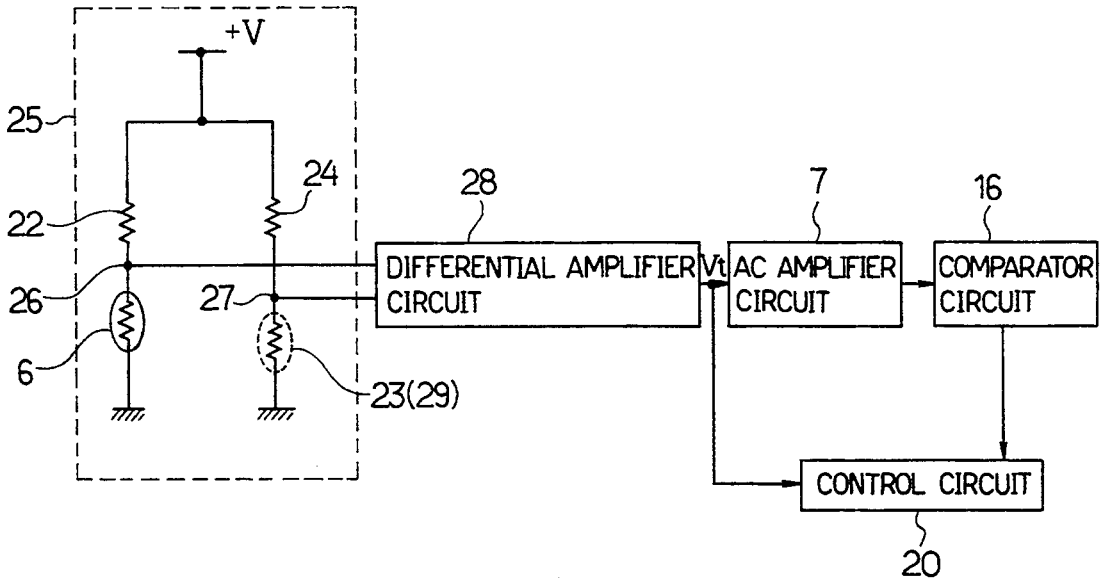
Figure 13:
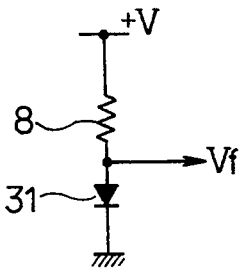
Figure 14:
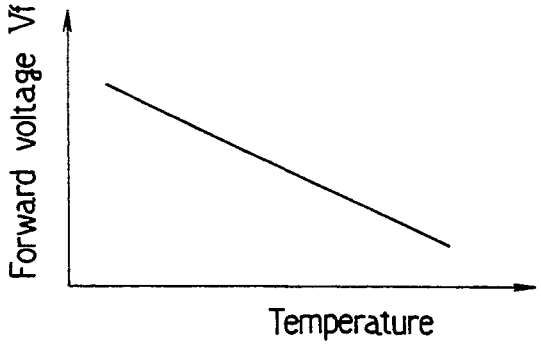
Figure 15:
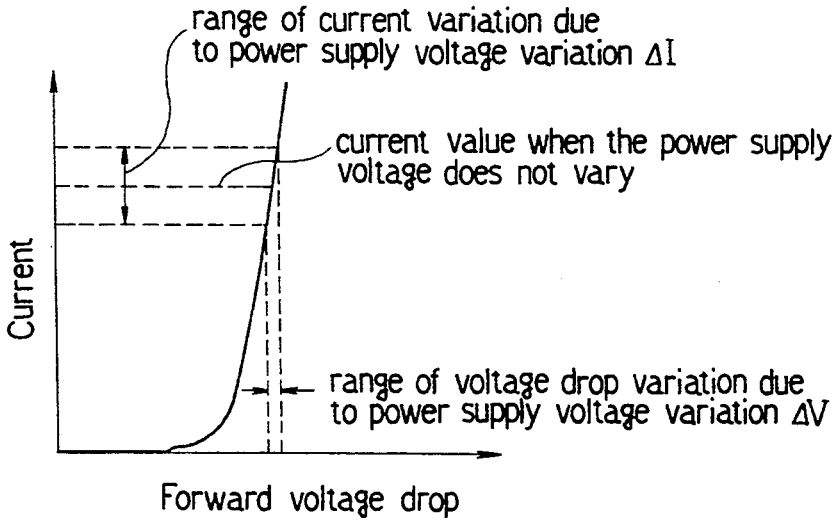
Figure 16:
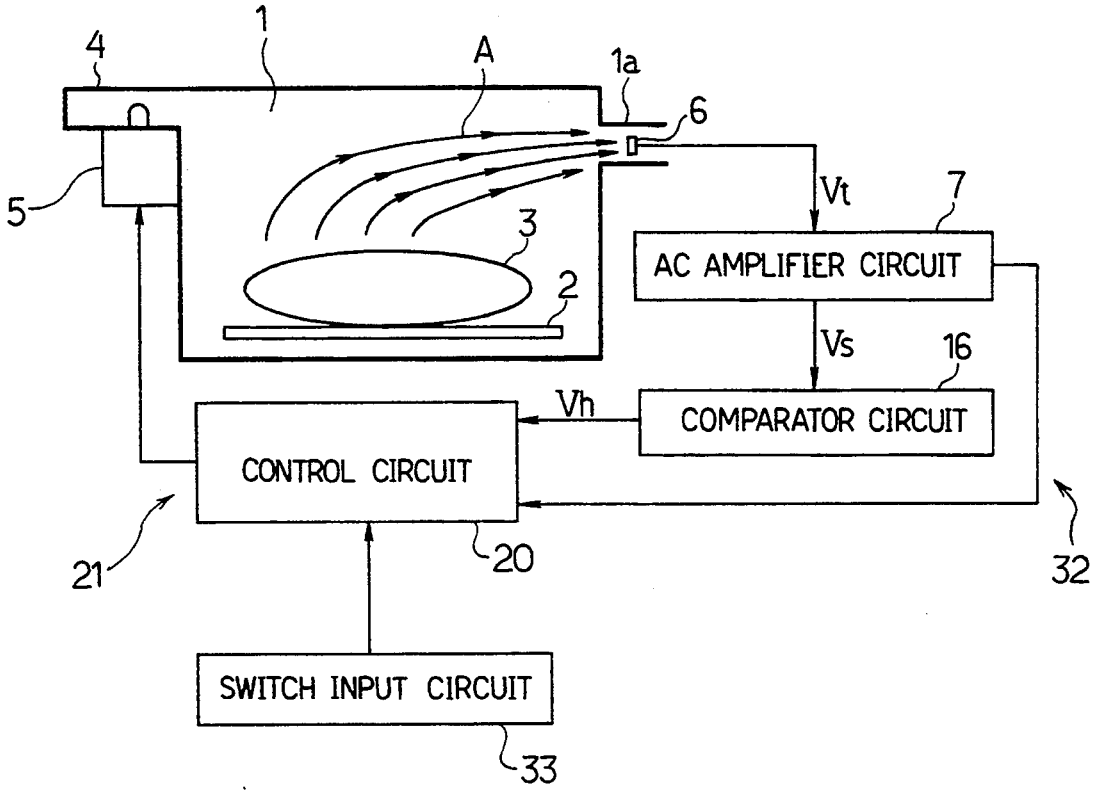
Figure 17:
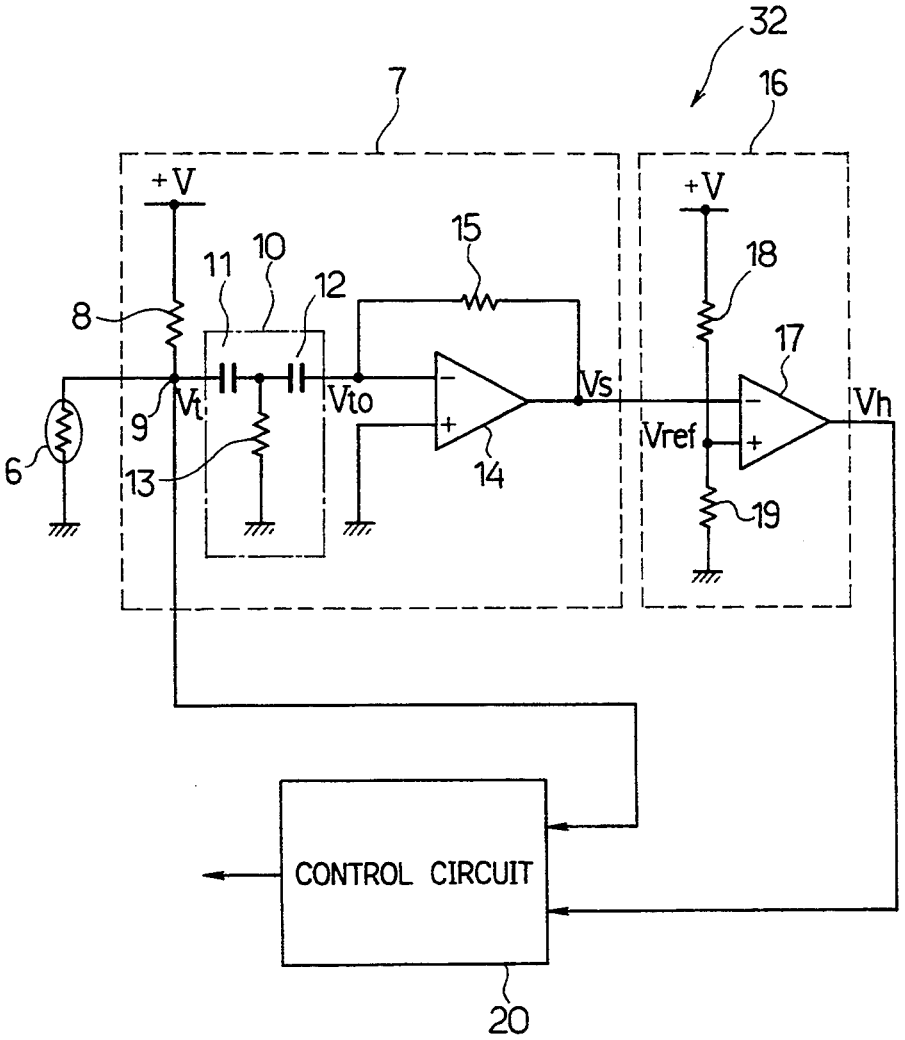
Figure 18:
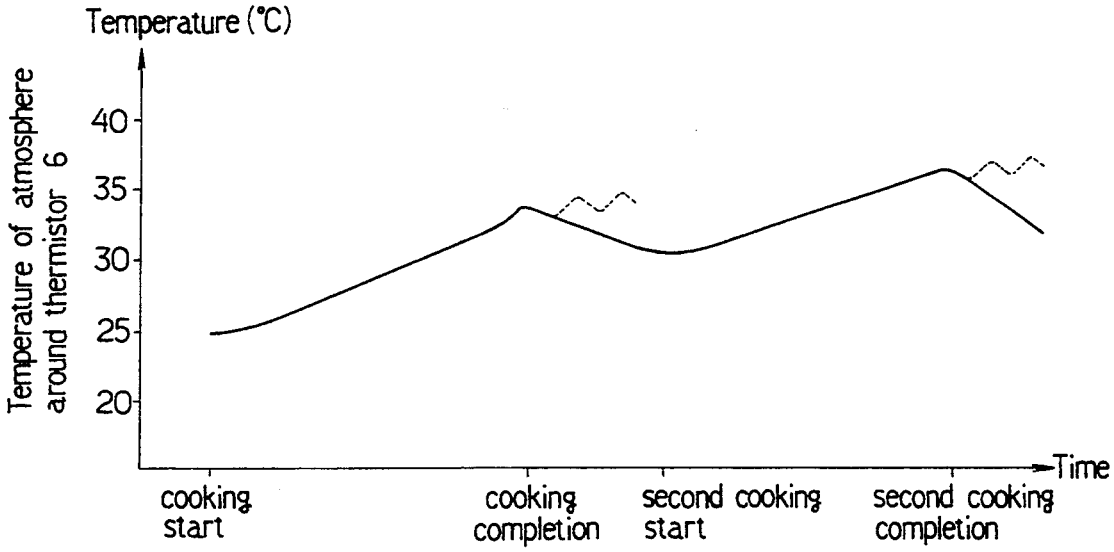
Figure 19:
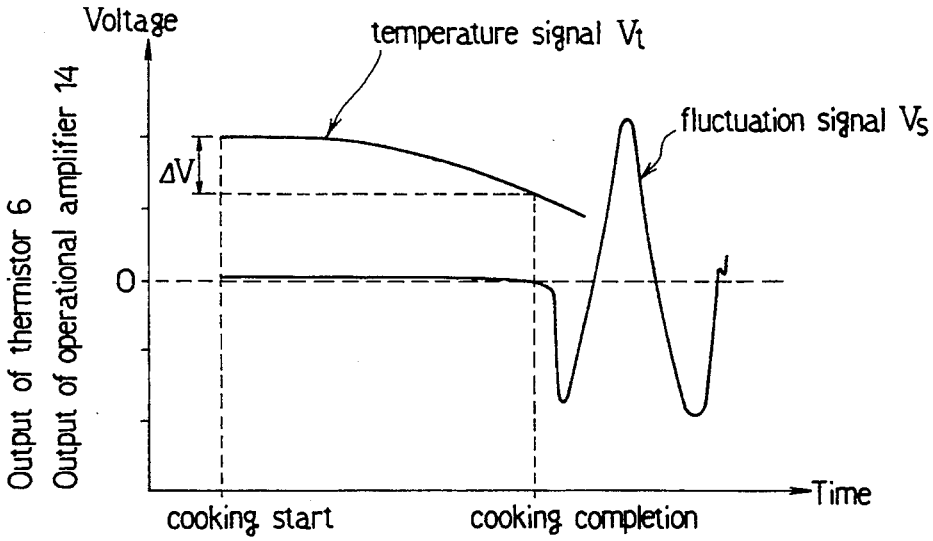
Figure 20:
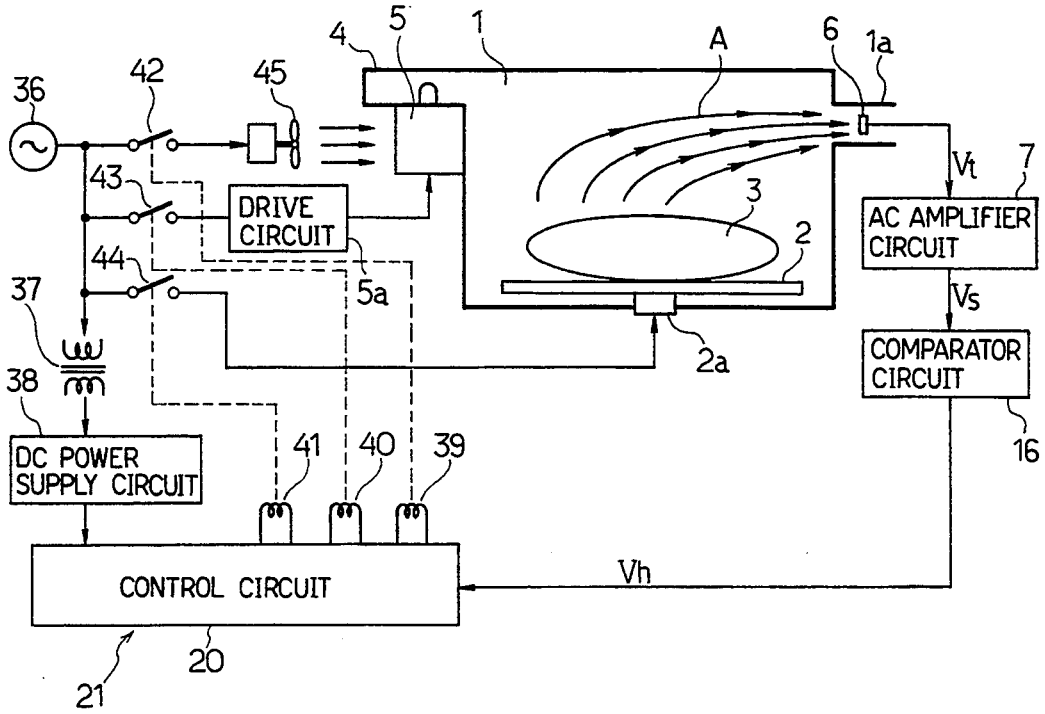
Figure 21:
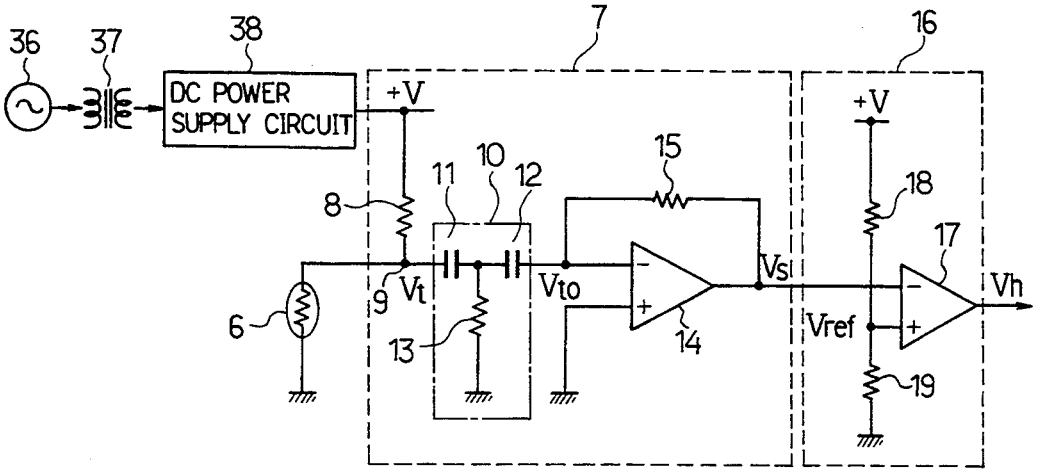
Figure 22:
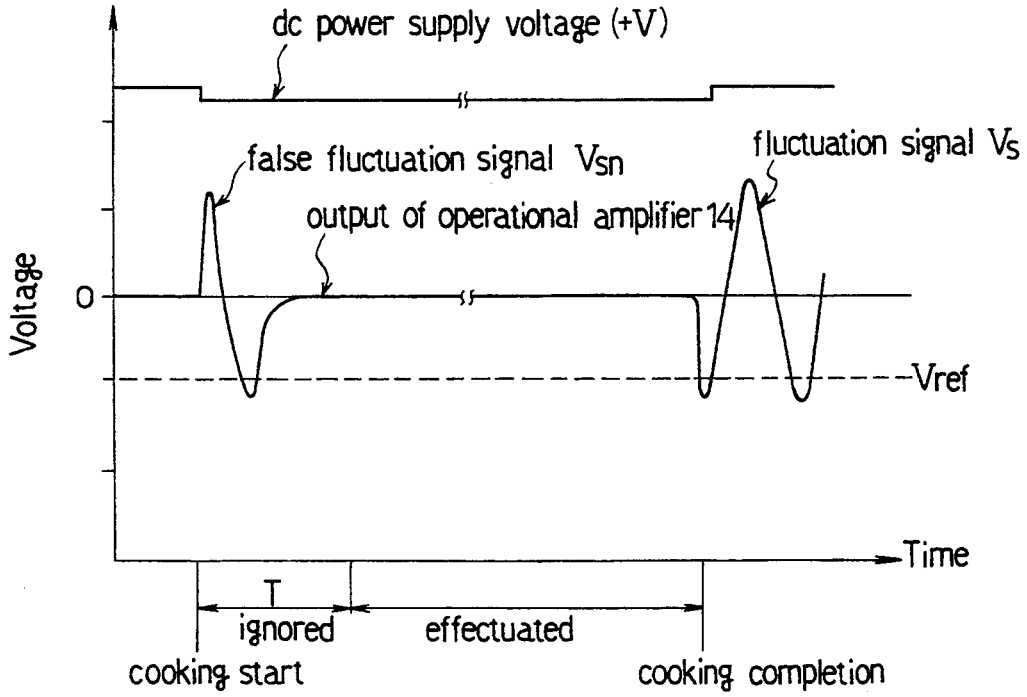
Figure 23:
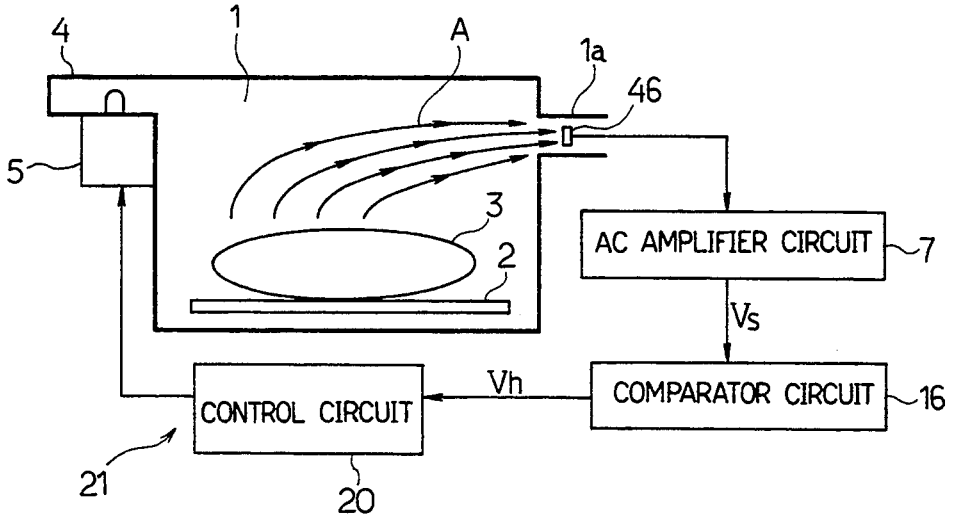
Figure 24:
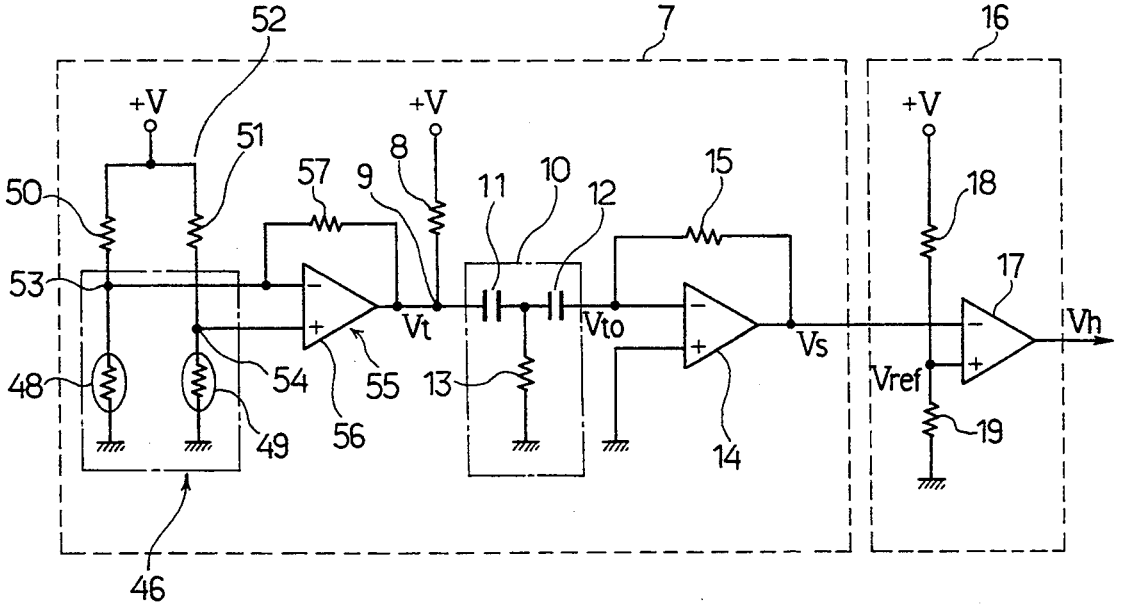
Figure 25:
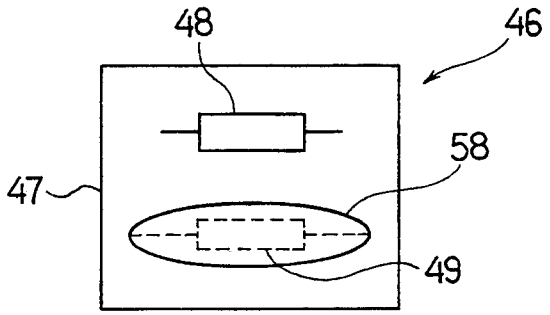
Figure 26:
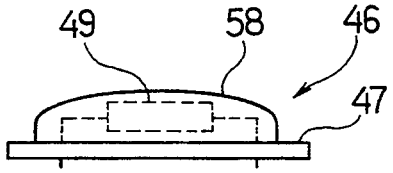
Figure 27:
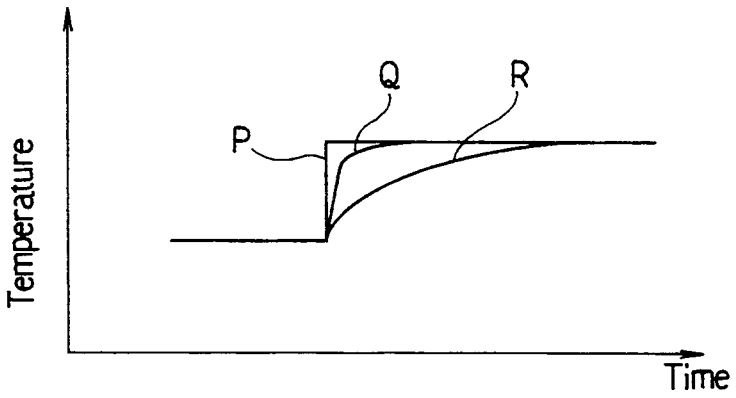
Figure 28:
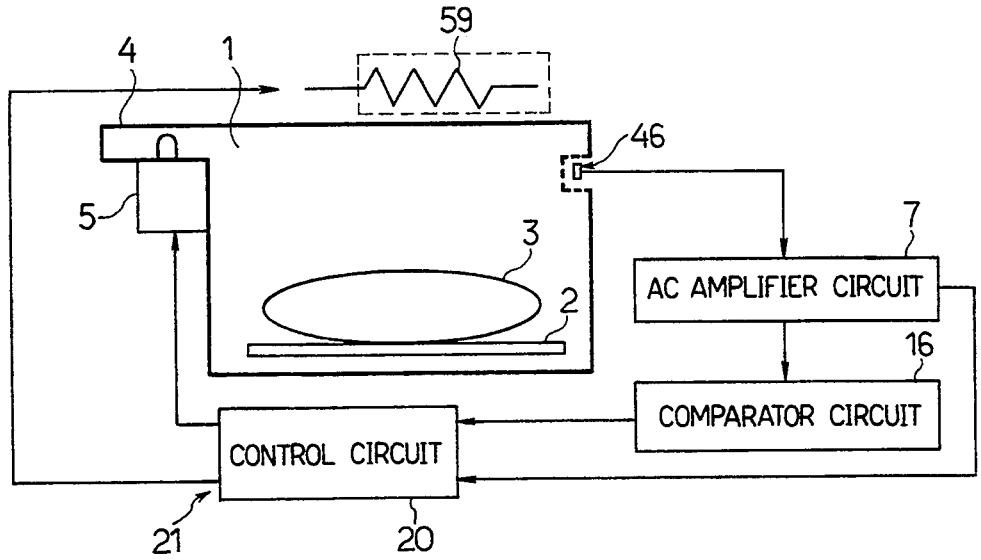
Figure 29:
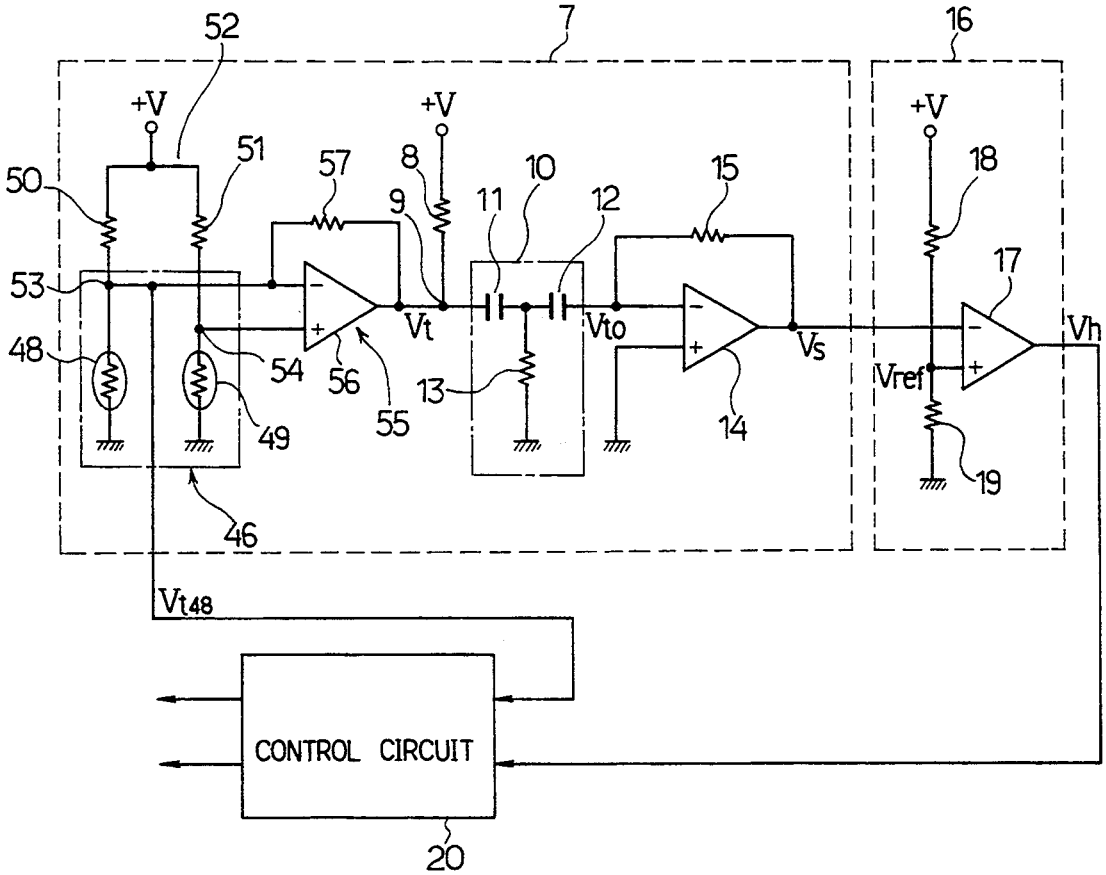

FIG, 2 is an electric circuit diagram showing an electrical arrangement of the microwave oven;

FIG, 3 is a graph showing the change of the temperature of an atmosphere around the thermistor after initiation of the range heating;

FIG. 4 is a waveform chart of the output of an operational amplifier in an ac amplifier circuit;

FIG, 5 is aware form chart of the output of a comparator in a comparator circuit;

FIG, 6 is a view similar to FIG, 1 showing a second embodiment of the invention;

FIG, 7 is an electric circuit diagram showing a temperature sensing circuit employed in the microwave oven of a third embodiment;

FIG, 8 is a view similar to FIG, 1 showing a fourth embodiment of the invention;

FIG, 9 is a view similar to FIG, 1 showing a fifth embodiment of the invention;

FIG, 10 is a view similar to FIG, 2 showing the fifth embodiment;

FIG, 11 is a graph showing the relationship between the temperature in the heating chamber and the output voltage of the thermistor;

FIG. 12 is a view similar to FIG. 7 showing a sixth embodiment of the invention;

FIG. 13 is an electric circuit diagram showing a temperature sensing circuit employed in the microwave oven of a seventh embodiment of the invention;

FIG. 14 is a graph showing the relationship between the forward voltage of the silicon diode and the temperature;

FIG. 15 is a graph showing the relationship between the silicon diode forward voltage drop and the current;

FIG. 16 is a view similar to FIG. 1 showing the microwave oven of an eighth embodiment of the invention;

FIG. 17 is a view similar to FIG. 2 showing the eighth embodiment;

FIG. 18 is a graph similar to FIG. 3 showing the eighth embodiment;

FIG. 19 is a view similar to FIG. 4 showing the eighth embodiment;

FIG. 20 is a view similar to FIG. 1 showing the microwave oven of a ninth embodiment of the invention;

FIG. 21 is a view similar to FIG. 2 showing the ninth embodiment;

FIG. 22 is a graph similar to FIG. 4 showing the ninth embodiment;

FIG. 23 is a view similar to FIG. 1 showing the microwave oven of a tenth embodiment of the invention;

FIG. 24 is a view similar to FIG. 2 showing the tenth embodiment;

FIG. 25 is a plan view of the temperature sensing means;

FIG. 26 is a side view of the temperature sensing means;

FIG. 27 is a graph showing thermal responsive characteristics of first and second thermistors;

FIG. 28 is a view similar to FIG. 1 showing an eleventh embodiment of the invention; and FIG. 29 is a view similar to FIG. 2 showing the eleventh embodiment.

DESCRIPTION OF THE PREFERRED EMBODIMENTS

A first embodiment of the present invention will now be described with reference to FIGS. 1 through 5 of the drawings. A heating chamber 1 of a microwave oven has a turntable 2 provided on the bottom of the chamber. Food 3 to be cooked is placed on the turntable 2. A magnetron 5 is provided on an upper side wall of the heating chamber 1 and coupled with a waveguide 4. High frequency energy generated by the magnetron 5 is supplied through the waveguide 4 into the heating chamber 1, thereby range heating the food 3.

An exhaust duct 1*a* is provided on an upper side wall of the heating chamber 1 so as to be opposite to the magnetron 5. Temperature sensing means or a thermistor 6 having the negative temperature characteristic is provided in the exhaust duct 1*a*. A cooling fan (not shown) for cooling the magnetron 5 is driven during the range heating to introduce external air into the heating chamber 1 so that internal air in the heating chamber I is exhausted through the exhaust duct 1*a*, thereby ventilating the heating chamber 1.

An output signal of the thermistor 6 is supplied to an ac amplifier circuit 7 wherein only fluctuation components of the temperatures sensed by the thermistor 6 are amplified. An arrangement of the ac amplifier circuit is shown in FIG. 2. More specifically, a series circuit of a voltage dividing resistance 8 and the thermistor 6 is connected between adc power supply terminal (+V) and a ground terminal. A temperature signal $V_t$ produced at a common node of the voltage dividing resistance 8 and the thermistor 6 is supplied a low-frequency component blocking circuit 10. The low-frequency component blocking circuit 10 comprises two capacitors 11 and 12 series connected between the input and output of the circuit 10 and a resistance connected between the capacitors 11, 12 and to a ground terminal. When the temperature signal $V_t$ supplied thereto contains no temperature fluctuation component (ac component) or contains only dc component, the capacitors 11, 12 block the temperature signal $V_t$ such that the signal is not allowed to pass through the low-frequency component blocking circuit 10. On the other hand, the temperature signal $V_t$ is allowed to pass through the low-frequency component blocking circuit 10 when containing the temperature fluctuation component. A signal $V_{tO}$ generated by the low-frequency component blocking circuit 10 is supplied to an inverting input terminal (−) of an operational amplifier 14 to be amplified. A feedback resistance 15 is connected between an output terminal and the inverting input terminal (−) of the operational amplifier 14. A non-inverting input terminal (+) of the operational amplifier 14 is connected to a ground terminal. An output terminal of the ac amplifier circuit composed as described above is connected to an inverting input terminal (−) of a comparator 17 forming a part of a comparator circuit 16. A reference voltage $V_{ref}$ divided by two resistances 18 and 19 is supplied to a non-inverting input terminal (+) of the comparator 17.

An output terminal of the comparator 17 as an output terminal of the comparator circuit 16 is connected to a control circuit 20 (FIG. 1) controlling the operation of the magnetron 5 in a manner as will be described later. Thus, control means 21 comprises the ac amplifier circuit 7, the comparator circuit 16 and the control circuit 20.

The operation of the heating appliance arranged as described above will now be described. When the food 3 to be cooked is placed in the heating chamber 1 and the range heating is initiated, the magnetron 5 starts oscillating to generate the high frequency waves. The high frequency waves are radiated onto the food 3 to range-heat the same. During the range heating, the cooling fan (not shown) is driven to introduce external air into the heating chamber 1 so that air in the heating chamber 1 is exhausted through the exhaust duct 1*a*, and the temperature of the exhausted air is sensed by the thermistor 6. The temperature of the food 3 is gradually raised with progress of the heating and consequently, hot air including vapor gradually emanates from the food 3. Since the hot air flows as shown by arrows A in FIG. 1 to be contained in the exhausted air, the temperature of the exhausted air or that of an atmosphere around the thermistor 6 is gradually raised as shown in FIG. 3. The voltage level of the temperature signal $V_t$ supplied from the thermistor 6 to the low-frequency component blocking circuit 10 is gradually decreased with the raise in the exhausted air temperature. In this case, the change of the temperature signal $V_t$ level is gradual and accordingly, the temperature signal $V_t$ contains little temperature fluctuation component (ac component). Consequently, the temperature signal $V_t$ is disallowed to pass through the low-frequency component blocking circuit 10 and the output of the operational amplifier 14 or that of the ac amplifier circuit 7 remains approximately at 0 volts. See FIG. 4. Subsequently, when the temperature of the food 3 is raised high to about 100° C., a large quantity of hot air containing vapor emanates from the food 3. The vapor is flapped by the exhausted air, which causes fluctuations in the temperature of the atmosphere around the thermistor 6. Since the temperature signal $V_t$ generated by the thermistor 6 contains the fluctuation component (ac component) in such a condition, the signal is allowed to pass through the low-frequency component blocking circuit and supplied to the operational amplifier 14. The operational amplifier 14 amplifies the temperature signal $V_t$ and produces a fluctuation signal $V_s$ having a relatively large amplitude as shown in FIG. 4. The fluctuation signal $V_s$ is compared with the reference voltage $V_{ref}$ by the comparator 17 of the comparator circuit 16. A high level signal $V_h$ (FIG. 5) is supplied from the comparator 17 to the control circuit 20 when the fluctuation signal $V_s$ exceeds the reference voltage $V_{ref}$. The control circuit 20 operates to determine whether or not the pulse width of the high level signal $V_h$ produced from the comparator 17 is above a predetermined pulse width $T_w$. When it is determined that the pulse width of the high level signal $V_h$ is not above the predetermined pulse width $T_w$, the high level signal $V_h$ is ignored as an electrical noise, thereby continuing the range heating. Consequently, a highly reliable control is provided. When the pulse width of the high level signal $V_h$ exceeds the predetermined period $T_w$, the operation of the magnetron 5 is interrupted, thereby completing the range heating.

The present invention relies upon that the temperature of the atmosphere containing hot air emanating from the food starts fluctuating when the food is heated sufficiently by way of the range heating. The temperature of the atmosphere containing the hot air emanating from the food 3 during the range heating is sensed by the thermistor 6 as the temperature sensing means. The operation of the magnetron 5 is controlled based on the fluctuations of the temperatures sensed by the thermistor 6. Consequently, the range heating can be automatized by provision of the temperature sensing means (thermistor 6) without employing the conventional humidity sensor, gas sensor or microphone. Since the thermistor 6 serving as the temperature sensing means is cost effective and reliable in operation, the circuit arrangement is simplified and the cost of the microwave oven is reduced. Furthermore, since aged deterioration of the thermistor 6 is less and the operation thereof is not influenced by an external noise, highly reliable automatic cooking can be performed.

Although, in the foregoing embodiment, the operation of the magnetron is interrupted when the pulse width of the high level signal $V_h$ produced from the comparator 17 exceeds the predetermined pulse width $T_w$, the control manner should not be limited to this. For example, an additional heating may be performed for a predetermined period when the high level signal pulse width exceeds the predetermined pulse width $T_w$ and thereafter, the operation of the magnetron 5 may be interrupted. Furthermore, the output of the magnetron 5 may be reduced during the additional heating.

Figure 6:
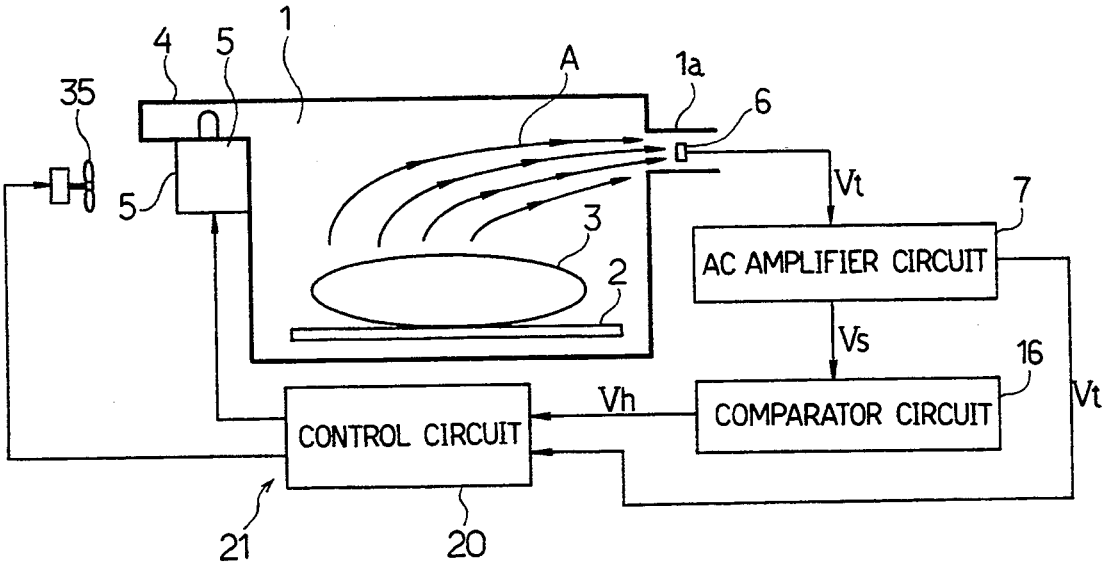

FIG. 6 illustrates a second embodiment of the invention. The temperature signal $V_t$ produced at the node 9 (FIG. 2) of the thermistor 6 is supplied both to the low-frequency component blocking circuit 10 and to the control circuit 20. After completion of the cooking, the control circuit 20 operates to drive the cooling fan 35 and prevent the initiation of the operation of the magnetron 5 until the temperature signal $V_t$ reaches a predetermined value (a value corresponding to 25° C., for example). The cooling fan 35 disposed so as to be opposite to the magnetron 5 operates so that external air blows against to the magnetron 5 for cooling the same and further so that the external air is introduced into the heating chamber 1 through a blowing opening (not shown), thereby ventilating the heating chamber. The exhaust air is exhausted through the exhaust duct 1*a*.

The temperatures of the atmosphere in the heating chamber 1 and the exhaust duct 1*a* are high immediately after completion of the cooking. Even if the range cooking is initiated in such a condition, it would be difficult to detect the temperature fluctuations since the fluctuation amplitude of the temperature of the atmosphere around the thermistor 6 is small, and accordingly, the automatic cooking would fail.

In accordance with the second embodiment, however, the control circuit 20 operates to detect the temperature of the atmosphere in the exhaust duct la after completion of the heating by the temperature signal $V_t$ produced from the thermistor 6. Since it is difficult to detect the temperature fluctuations when the detected temperature is above the predetermined value, for example, 25° C., the cooling fan 35 is driven so that the heating chamber and exhaust duct interiors are force cooled until the detected temperature reduces to the predetermined value. Consequently, since the temperatures of the atmospheres in the heating chamber 1 and the exhaust duct 1*a* can be rapidly decreased below the predetermined value, the period of the high temperature condition after completion of the heating or the period in which it is difficult to detect the temperature fluctuations can be shortened. Thus, the microwave oven can recover its automatic cooking starting state quickly after completion of the previous heating.

Furthermore, the operation of the magnetron 5 is not initiated when the temperature sensed by the thermistor 6 is above the predetermined value after completion of the cooking. Even when the user actuates a heating start key (not shown) during the period that it is difficult to detect the temperature fluctuations, the range heating is not allowed to start. Thus, failure of the automatic cooking can be prevented.

Warning means such a display or buzzer may be provided for warning the user when the range heating cannot be initiated with the sensed temperature above the predetermined value. In this case, the user fears that something is wrong with the appliance since the range heating cannot be initiated. However, the arrangement of the second embodiment can sweep away such a fear.

FIG. 7 illustrates a third embodiment of the invention. The temperature sensing means comprises a bridge circuit 25 composed of the thermistor 6 and three resistances 22, 23 and 24. The dc power supply voltage (+V) is applied to the bridge circuit 25. The relationship between the resistance value $R_1$ of the thermistor 6 at the room temperature and the resistance values $R_2$, $R_3$ and $R_4$ of the respective resistances 22–24 is set as follows:

$$R_1 \cdot R_4 = R_2 \cdot R_3$$

The potential difference between both output terminals 26, 27 of the bridge circuit 25 is detected by the differential amplifier circuit 28. An output signal produced from the differential amplifier circuit 28 is supplied as the temperature signal $V_t$ to the ac amplifier circuit 7. The other arrangement is the same as in the first embodiment.

Since the bridge circuit 25 is composed by use of the thermistor 6 in the third embodiment, the variations in the dc power supply voltage (+V) may be offset. Consequently, this arrangement is advantageous in that the reduction in the temperature sensing accuracy due to the variations in the dc power supply voltage (+V) can be prevented.

Figure 8:
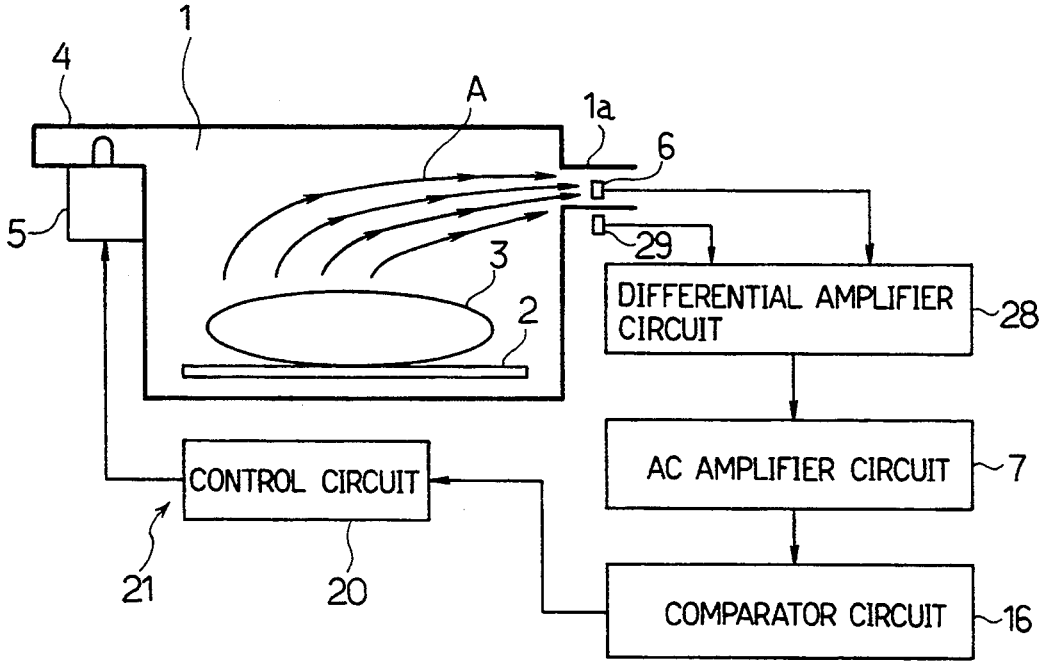

One of the resistances composing the bridge circuit 25 may be comprised of a thermistor 29 same as the thermistor 6 and the thermistor 29 may be disposed in a position where it is not influenced by the exhaust air temperature, for example, the outside of the exhaust duct 1*a*, as is shown as a fourth embodiment of the invention in FIG. 8. In the fourth embodiment, when the atmospheric temperature varies to a large extent, the resistance values of the respective thermistors 6, 29 also varies, thereby offsetting the variations in the atmospheric temperature. Consequently, the reduction in the temperature sensing accuracy due to the variations in the atmospheric temperature can be prevented.

Figure 9:
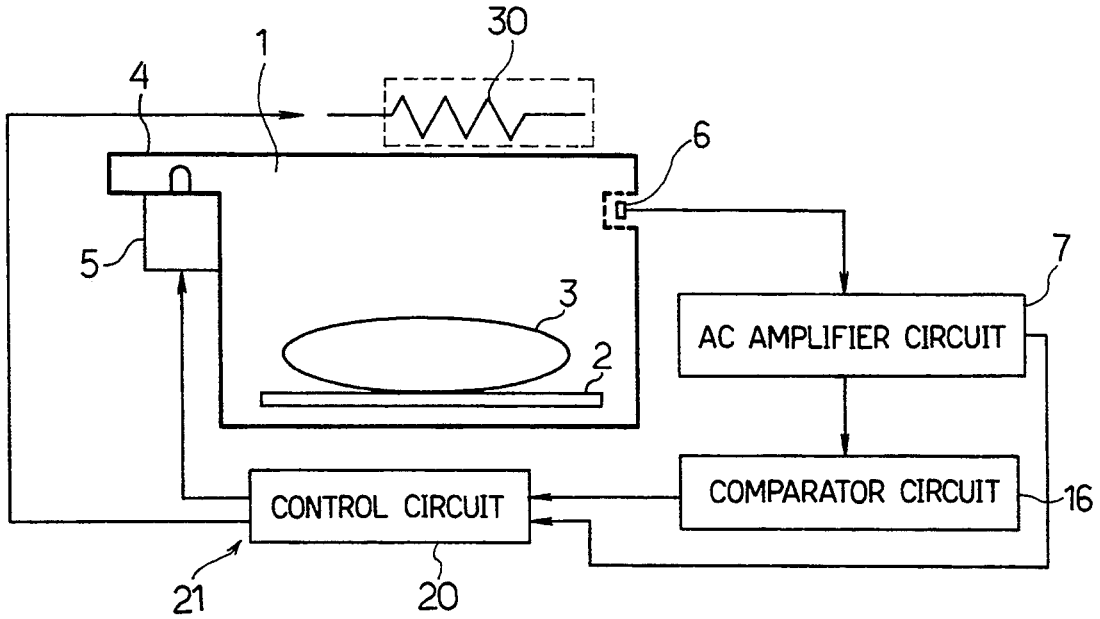
Figure 10:
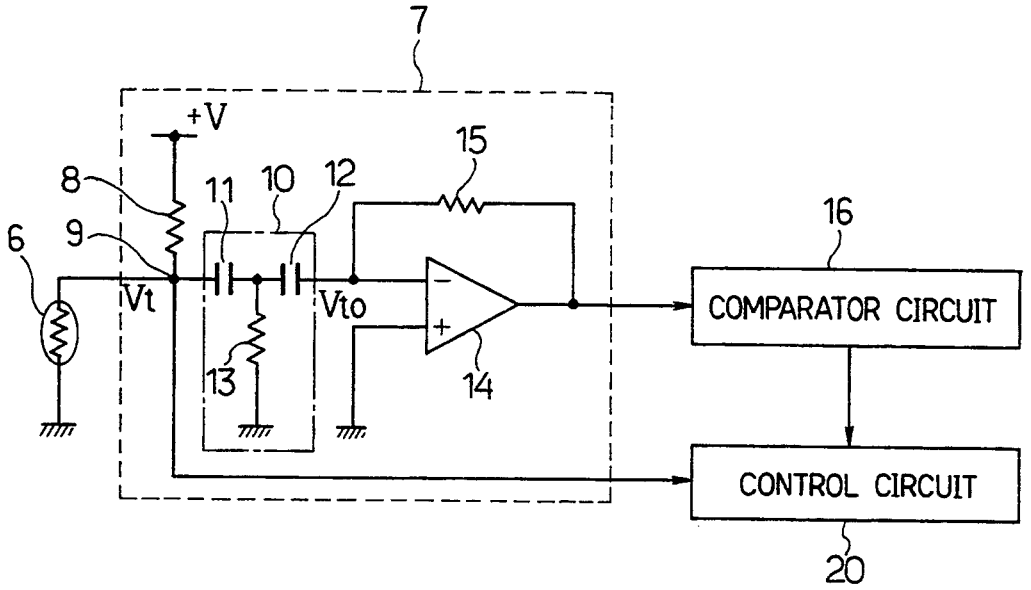
Figure 11:
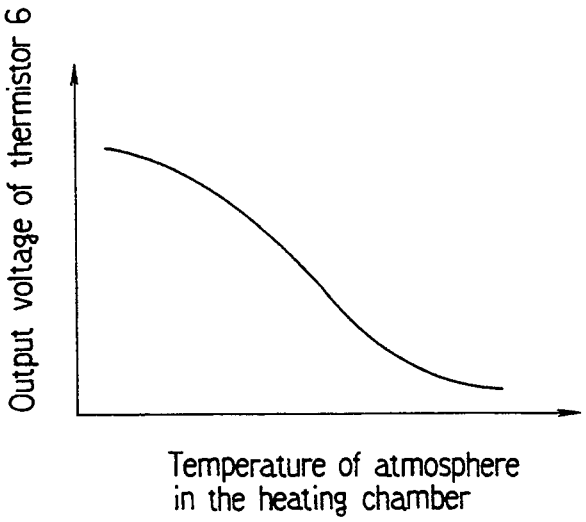

FIGS. 9–11 illustrate a fifth embodiment of the invention. A heater 30 for an oven cooking is provided on the ceiling of the heating chamber 1 of the first embodiment. The control means 21 operates to control energization of the heater 30 based on the temperature sensed by the thermistor 6. The thermistor 6 is disposed so as to face the interior of the heating chamber 1. The temperature signal $V_t$ produced from the thermistor 6 is supplied both to the low-frequency component blocking circuit 10 and to the control circuit 20, as shown in FIG. 10. The control circuit 20 operates to control energization of the heater 30 based on the supplied temperature signal $V_t$. More specifically, in execution of the oven cooking with the heater 30 energized, the voltage level of the temperature signal $V_t$ generated by the thermistor 6 is reduced with increase in the temperature of the atmosphere in the heating chamber 1. See FIG. 11. Accordingly, the control circuit 20 operates to deenergize the heater 30 when the voltage level of the temperature signal $V_t$ is reduced below a predetermined level or when the temperature of the atmosphere in the heating chamber I is raised to a predetermined value or above. Thereafter, when the temperature signal voltage level is increased to the predetermined level or above with the heating chamber atmospheric temperature decreased, the heater 30 is re-energized. Energization and deenergization of the heater 30 are alternately repeated so that the oven cooking is executed with the heating chamber atmospheric temperature maintained approximately at the predetermined value.

In the fifth embodiment, the atmospheric temperature in the heating chamber is high immediately after completion of the previous oven cooking. Accordingly, the cooking control based on the temperature sensed by the thermistor 6 cannot be performed even when the range heating is initiated. In this case, the cooling fan (not shown) is operated until the temperature sensed by the thermistor 6 is decreased below the predetermined value and the range heating operation is prevented from being initiated, as in the second embodiment. Furthermore, the alarm means is actuated.

In accordance with the fifth embodiment, energization of the heater 30 is controlled based on the temperature sensed by the thermistor 6 in the oven cooking. Consequently, a single thermistor 6 can be effectively used both for the range heating and for the oven cooking.

As shown as a sixth embodiment in FIG. 12, the above-described microwave oven with the heater 30 may be provided with the bridge circuit 25 including the thermistor 6 so that the dc power supply voltage (+V) and temperature variations are offset, as in the third and fourth embodiments. In this embodiment, the potential difference between the output terminals 26, 27 of the bridge circuit 25 is detected by the differential amplifier 28. The output signal from the differential amplifier 28 is supplied as the temperature signal $V_t$ both to the ac amplifier circuit 7 and to the control circuit 20. Energization of the heater 30 is controlled by the control circuit 20 based on the temperature signal $V_t$.

Although energization of the heater 30 for the oven cooking is controlled based on the temperature sensed by the thermistor 6 in the foregoing fifth and sixth embodiments, energization of a heater for the grill cooking may be controlled, instead.

Furthermore, the temperature sensing means should not be limited to the thermistor 6. Instead of the thermistor 6, a silicon diode 31 may be provided as shown as a seventh embodiment in FIGS. 13 through 15 and the temperature may be sensed by utilizing the negative temperature dependency of the forward voltage drop of the silicon diode 31. More specifically, the silicon diode 31 forward voltage $V_f$ characteristically drops linearly with the temperature increase, as shown in FIG. 14. This arrangement employing the silicon diode 31 is advantageous in that even when the current flowing into the silicon diode 31 varies with variations in the dc power supply voltage (+V), the variation range ΔV of the forward voltage drop is extremely small relative to the current variation range ΔI. Consequently, influences of the dc power supply voltage (+V) variations can be reduced without employing the bridge circuit as described above. Additionally, a transistor temperature sensor may be employed as the temperature sensing means, for example.

FIGS. 16 through 19 illustrate an eighth embodiment of the invention. The difference between the first and eighth embodiments will be described. The temperature fluctuation detecting means 32 comprises the ac amplifier circuit 7 and the comparator circuit 16. The high level signal $V_h$ as the fluctuation signal is generated by the comparator 17 of the comparator circuit 16. The temperature signal $V_t$ generated by the thermistor 6 is supplied both to the low-frequency component blocking circuit 10 and to the control circuit 20. Based on the supplied temperature signal $V_t$, the control circuit 20 operates to control the operation of the magnetron 5. The control circuit 20 forms a part of the control means 21 and is supplied with a switch signal from a switch input circuit 33 comprising a cooking course selecting switch for selecting either a first course in which the temperature fluctuations are detected to thereby execute the automatic cooking or a second course in which the temperature is sensed to thereby execute the automatic heating, that is, in which the range cooking is interrupted before occurrence of the temperature fluctuations. Either one of the two cooking courses is selected by manually operating the cooking course selecting switch.

The heating is controlled in the same manner as in the first embodiment when the first cooking course is selected. More specifically, the fluctuation signal $V_s$ having a relatively large amplitude as shown in FIG. 4 is generated by the operational amplifier 14. The comparator 17 of the comparator circuit 16 operates to compare the fluctuation signal $V_s$ generated by the operational amplifier 14 with the reference voltage $V_{ref}$. The control circuit 20 effectuates input of the high level signal $V_h$ (FIG. 5) as a fluctuation detection signal generated by the comparator 17, thereby deenergizing the magnetron 5 to complete the range heating FIG. 18 shows temperature changes in the case where the range heating is executed twice. Broken lines in FIG. 18 denote the temperature change in the case where the range heating is continuously executed without interrupting the operation of the magnetron 5.

The case will be described where the automatic cooking course is executed based on the sensed temperature, for example, where rice is re-heated by way of the range heating. In this cooking mode, the range heating is interrupted before occurrence of the temperature fluctuations, as described above. The control circuit 20 effectuates input of the temperature signal $V_t$ generated by the thermistor 6. The magnetron 5 is controlled based on the temperature signal $V_t$. More specifically, the food 3 is heated in the same manner as described above and accordingly, the temperature of the exhausted air or the temperature of the atmosphere around the thermistor 6 is gradually increased. The voltage level of the temperature signal $V_t$ generated by the thermistor 6 is gradually reduced with the temperature increase. The control circuit 20 operates to interrupt the operation of the magnetron 5 to complete the range heating when the voltage level of the temperature signal $V_t$ is reduced by a predetermined range ΔV, as shown in FIG. 19.

In accordance with the eighth embodiment, the temperature of the atmosphere containing hot air emanating from the food 3 being cooked begins to fluctuate when the food 3 is well heated by way of the range heating. The atmospheric temperature is sensed by the thermistor 6 as the temperature sensing means. Since the operation of the magnetron 5 is controlled based on the fluctuations of the temperature sensed by the thermistor 6, the automatic range heating can be achieved without employing the conventionally used humidity sensor, gas sensor or microphone. Since the thermistor 6 employed as the temperature sensing means is cost effective and reliable in operation, the circuit arrangement can be simplified and the production cost can be reduced. Furthermore, since the thermistor 6 has less aged deterioration and is not influenced by the external noise, the highly reliable automatic cooking can be performed.

In the case where the range heating needs to be interrupted before occurrence of the temperature fluctuations, for example, rice is re-heated by way of the range heating, the second cooking course wherein the temperature is sensed to thereby execute the automatic cooking is selected. As shown in FIG. 19, the operation of the magnetron 5 is interrupted to complete the range heating when the voltage level of the temperature signal $V_t$ is reduced by a predetermined voltage ΔV. Consequently, since the range heating can be interrupted before occurrence of the temperature fluctuations, suitable automatic cooking can be performed for various kind of food.

FIGS. 20 through 22 illustrate a ninth embodiment of the invention. In FIG. 20, the control means 21 comprises the ac amplifier circuit 7, comparator circuit 16 and control circuit 20. The control circuit 20 is energized from a dc power supply circuit 38 connected to the commercial power supply through a power supply transformer 37. The control circuit 20 comprises a microcomputer, for example. In accordance with a control program provided in the microcomputer, the control circuit 20 operates to on-off control relay switches 42 through 44 provided in power supply paths of the cooling fan 45, a drive circuit 5*a* of the magnetron 5 and a motor 2*a*for turning the turntable 2 respectively in the following manner. That is, upon initiation of the range heating with the food 3 contained in the heating chamber 1, the control circuit 20 operates to energize relay coils 39 to 41, thereby turning on the relay switches 42–44. Consequently, the magnetron 5 initiates the oscillation operation to generate high frequency waves, which are radiated onto the food 3, thereby heating the same. Simultaneously, turn-on of the relay switch 42 drives the cooling fan 45 so that the external air is introduced into the heating chamber 1 and the air in the heating chamber 1 is exhausted through the exhaust duct 1*a*. The temperature of the exhausted air is sensed by the thermistor 6. The motor 2*a* is energized as the result of turn-on of the relay switch 44 to turn the turntable 2 during the cooking, whereby the food 3 on the turntable 2 is uniformly heated.

The temperature of the food 3 is gradually increased with progress of the heating and the hot air emanates from the food 3. The hot air is contained in the exhausted air as shown by the arrows A in FIG. 20 and accordingly, the temperature of the exhausted air or the temperature of the atmosphere around the thermistor 6 is gradually increased as shown in FIG. 3. The voltage level of the temperature signal $V_t$ supplied to the low-frequency component blocking circuit 10 from the thermistor 6 is gradually reduced with the temperature increase. However, the change of the signal $V_t$ level is gradual and accordingly, the temperature signal $V_t$ contains little temperature fluctuation component (ac component). Consequently, the temperature signal $V_t$ is disallowed to pass through the low-frequency component blocking circuit 10 and the output of the operational amplifier 14 or that of the ac amplifier circuit 7 remains approximately at 0 volts. See FIG. 22. Subsequently, when the temperature of the food 3 is raised high to about 100° C., a large quantity of hot air emanates from the food 3. The hot air is flapped by the exhausted air, which causes fluctuations in the temperature of the atmosphere around the thermistor 6. Since the temperature signal $V_t$ generated by the thermistor 6 contains the fluctuation component (ac component) in such a condition, the signal is allowed to pass through the low-frequency component blocking circuit 10 and supplied to the operational amplifier 14. The operational amplifier 14 amplifies the temperature signal $V_t$ and produces a fluctuation signal $V_s$ having a relatively large amplitude as shown in FIG. 22. The fluctuation signal $V_s$ is compared with the reference voltage $V_{ref}$ by the comparator 17 of the comparator circuit 16. A high level signal $V_h$ (FIG. 5) is supplied from the comparator 17 to the control circuit 20 when the fluctuation signal $V_s$ exceeds the reference voltage $V_{ref}$. The control circuit 20 operates to determine whether or not the pulse width of the high level signal $V_h$ produced from the comparator 17 is at a predetermined pulse width $T_w$ or above. When it is determined that the pulse width of the high level signal $V_h$ is not at the predetermined pulse width $T_w$ nor above, the high level signal $V_h$ is ignored as an electrical noise, thereby continuing the range cooking. Consequently, a highly reliable control is provided. When the pulse width of the high level signal $V_h$ exceeds the predetermined pulse width $T_w$, the operation of the magnetron 5 is interrupted, thereby completing the range heating.

The dc power supply voltage (+V) as the output voltage of the dc power supply circuit 38 varies upon initiation of the heating since the loads such as the magnetron 5, cooling fan 45 and the turntable motor 2a are simultaneously operated, as shown in FIG. 22. Furthermore, the dc power supply voltage (+V) also varies when the magnetron 5 or the like is automatically changed from one operating or output condition to another in the course of the cooking. When the dc power supply voltage (+V) varies at the start of the cooking and in the midst thereof, the output voltage of the thermistor 6 or the temperature signal $V_t$ also varies. When the temperature signal $V_t$ the voltage level of which is varying is amplified by the operational amplifier 14, a false fluctuation signal $V_{sn}$ is produced from the operation amplifier 14 as shown in FIG. 22. The false fluctuation signal $V_{sn}$ can be mistaken as indicative of the temperature fluctuations when processed in the same manner as processing the fluctuation signal $V_s$, which causes a false operation.

In the ninth embodiment, however, the control program of the microcomputer is designed as follows. That is, when the change of the operating conditions of the load such as the magnetron 5 causes the dc power supply voltage (+V) to vary, the control based on the temperature fluctuations or the output signal from the operational amplifier 14 is interrupted during lapse of a predetermined period T, which period starts at the time when the operating conditions of the load is changed and ends when the output of the operational amplifier is stabilized. The operation of the magnetron 5 is controlled under the condition that it is considered that the temperature fluctuations do not occur, during the interruption of the control based on the temperature fluctuations. Consequently, the false fluctuation detecting operation due to the dc power supply voltage variations can be prevented, which prevents the automatic cooking from failing. Thus, the reliability of the automatic cooking can be improved.

FIGS. 23 through 27 illustrate a tenth embodiment of the invention. Referring to FIG. 23, the temperature sensing means 46 is provided in the exhaust duct 1a. The temperature sensing means 46 comprises a base plate 47, a first thermistor 48 having the negative temperature characteristic and serving as a first temperature sensing element and a second thermistor 49 having the negative temperature characteristic and serving as a second temperature sensing element, as shown in FIGS. 25 and 26. Both of the thermistors 48, 49 are mounted on the base plate 47 and the second thermistor 49 is covered by a resin cover 58 such that the thermal responsibility of the second thermistor 49 differs from that of the first thermistor 48 as shown in FIG. 27. More specifically, the second thermistor 49 is inferior in the thermal responsibility than the first thermistor 48. In FIG. 27, a solid line P denotes the change of the ambient temperature, a solid line Q the change of temperature sensed by the first thermistor 48 and a solid line R the change of the temperature sensed by the second thermistor 49. During the range heating, the blower fan (not shown) is driven to introduce the external air into the heating chamber I so that the air in the heating chamber 1 is exhausted through the exhaust duct 1a, thereby exhausting the heating chamber 1.

Temperature signals generated by the first and second thermistors 48, 49 respectively are supplied to the ac amplifier circuit 7. The fluctuation component is detected by the ac amplifier circuit 7 based on the difference between the output levels of the temperature signals and only the detected fluctuation component is amplified. The arrangement of the ac amplifier circuit 7 is shown in FIG. 24. More specifically, a bridge circuit 52 is composed of the first and second thermistors 48, 49 and two resistances 50 and 51. The dc power supply voltage (+V) is applied to the bridge circuit 52. The relationship between the resistance values $r_1$ and $r_2$ of the first and second thermistors 48, 49 at the room temperature respectively and the resistance values $r_2$ and $r_3$ of the resistances 50, 51 respectively is set as follows:

$$r_1 \cdot r_4 = r_2 \cdot r_3$$

The potential difference between the output terminals 53 and 54 of the bridge circuit 52 is detected by the differential amplifier circuit 55 and an output signal from the differential amplifier circuit 55 is supplied as the temperature signal $V_t$ to the low-frequency component blocking circuit 10. The differential amplifier circuit 55 comprises an operational amplifier 56 and a feedback resistance 57.

In operation, when the food 3 to be cooked is placed in the heating chamber 1 and the high frequency cooking is initiated, the magnetron 5 starts oscillating to generate the high frequency waves. The high frequency waves are radiated onto the food 3 to high-frequency heat the same. During the high-frequency heating, the cooling fan (not shown) is driven to introduce external air into the heating chamber 1 so that internal air in the heating chamber 1 is exhausted through the exhaust duct 1*a*, and the temperature of the exhausted air is sensed by the first and second thermistors 48, 49. The temperature of the food 3 is gradually raised with progress of the cooking and consequently, hot air including vapor gradually emanates from the food 3. Since the hot air flows as shown by the arrows A in FIG. 1 to be contained in the exhausted air, the temperature of the exhausted air or that of an atmosphere around the thermistors 48, 49 is gradually raised as shown in FIG. 3. The voltage level of the temperature signal $V_t$ supplied from the bridge circuit 52 having the thermistors 48, 49 to the low-frequency component blocking circuit 10 through the differential amplifier circuit 55 is gradually decreased with the raise in the exhausted air temperature. In this case, the change of the temperature signal $V_t$ level is gradual and accordingly, the temperature signal $V_t$ contains little temperature fluctuation component (ac component). Consequently, the temperature signal $V_t$ is disallowed to pass through the low-frequency component blocking circuit 10 and the output of the operational amplifier 14 or that of the ac amplifier circuit 7 remains approximately at 0 volts. See FIG. 4. Subsequently, when the temperature of the food 3 is raised high to about 100° C., a large quantity of hot air emanates from the food 3. The hot air is flapped by the exhausted air, which causes fluctuations in the temperature of the atmosphere around the first and second thermistors 48, 49. Since the second thermistor 49 is covered by the resin cover 58 so as to have the thermal responsibility different from that of the first thermistor 48, the temperature signal $V_t$ supplied from the bridge circuit 52 having the thermistors 48, 49 through the differential amplifier 55 contains the fluctuation component (ac component) in such a condition, the signal $V_t$ is allowed to pass through the low-frequency component blocking circuit 10 and supplied to the operational amplifier 14. The operational amplifier 14 amplifies the temperature signal $V_t$ and produces a fluctuation signal $V_s$ having a relatively large amplitude as shown in FIG. 4. The fluctuation signal $V_s$ is compared with the reference voltage $V_{ref}$ by the comparator 17 of the comparator circuit 16. A high level signal $V_h$ (FIG. 5) is supplied from the comparator 17 to the control circuit 20 when the fluctuation signal $V_s$ exceeds the reference voltage $V_{ref}$. The control circuit 20 operates to determine whether or not the pulse width of the high level signal $V_h$ produced from the comparator 17 is at a predetermined pulse width $T_w$ or above. When it is determined that the pulse width of the high level signal $V_h$ is not at the predetermined pulse width $T_w$ or above, signal $v_h$ is ignored as an electrical noise, thereby continuing the high frequency cooking. Consequently, a highly reliable control is provided. When the pulse width of the high level signal $V_h$ exceeds the predetermined pulse width $T_w$, the operation of the magnetron 5 is interrupted, thereby completing the high frequency cooking.

In accordance with the tenth embodiment, the same effect can be achieved as in the first embodiment. In particular, since the temperature fluctuation is detected based on the difference between the output levels of the temperature signals generated by the first and second thermistors 48, 49, the resistance values of the respective thermistors 48, 49 varies all in the same manner even when the ambient temperature changes to a large extent. Consequently, the change of the ambient temperature can be offset and accordingly, the accuracy in the temperature fluctuation can be prevented from being reduced by the change in the ambient temperature. Furthermore, the provision of the bridge circuit 52 can offset the variations in the dc power supply voltage (+V), which prevents the temperature sensing accuracy from being reduced by the dc power supply voltage variations.

Since the second thermistor 49 is only covered by the resin cover 58 in order to obtain the same having the thermal responsibility different from that of the first thermistor 48, the construction for that purpose can be attained with ease. Furthermore, since the two thermistors 48, 49 are mounted on a single base plate 47, handling of the parts can be simplified in the assembly, thereby improving the assembly efficiency.

Although the second thermistor 49 is covered by the resin cover 58 in the foregoing embodiment, it may be covered by a metal or ceramic cover. Further, the second thermistor 49 may be molded with a resin or the like instead of being covered by the resin.

FIGS. 28 and 29 illustrate an eleventh embodiment of the invention. Difference between the tenth and eleventh embodiments will be described. A heater 59 for the oven cooking is provided on the upper side wall of the heating chamber 1. Energization of the heater 59 is controlled by the control means 21 based on the temperature sensed by the first thermistor 48. The first thermistor 48 is disposed so as to face the interior of the heating chamber 1. The temperature signal $V_{t48}$ generated by the first thermistor 48 is supplied both to the differential amplifier 55 and to the control circuit 20. Based on the temperature signal $V_{t48}$, the control circuit 20 operates to control energization of the heater 59.

The same effect can be achieved in the eleventh embodiment as in the foregoing fifth embodiment.

The foregoing disclosure and drawings are merely illustrative of the principles of the present invention and are not to be interpreted in a limiting sense. The only limitation is to be determined from the scope of the appended claims.

We claim:

1. A microwave oven comprising:

a) a heating chamber in which food to be cooked is contained;

b) a magnetron for range-heating the food contained in the heating chamber;

c) temperature sensing means for sensing the temperature of an atmosphere containing hot air emanating from the food being range-heated in the heating chamber, thereby generating a first temperature signal;

d) temperature fluctuation detecting means connected to the temperature sensing means for receiving the temperature signal from the temperature sensing means, the temperature fluctuation detecting means generating a temperature fluctuation signal when detecting a temperature fluctuation in which the temperature sensed by the temperature sensing means rises and falls for a short period of time;

e) control means connected to the temperature fluctuation detecting means for controlling an operation of the magnetron in response to the temperature fluctuation signal; and f) wherein the temperature sensing means comprises a first temperature sensing element sensing the temperature of the atmosphere containing hot air emanating from the food being range-heated and a second temperature sensing element sensing the temperature of an atmosphere outside the appliance and the temperature fluctuation detecting means detects the temperature fluctuation on the basis of the difference between levels of temperature signals generated by the first and second temperature sensing elements respectively.

2. A microwave oven according to claim 1, which further comprises a turntable turned during the range-heating with the food placed thereon.

3. A microwave oven comprising:

a) a heating chamber in which food to be cooked is contained;

b) a magnetron for range-heating the food contained in the heating chamber;

c) temperature sensing means for sensing the temperature of an atmosphere containing hot air emanating from the food being range-heated in the heating chamber, thereby generating a temperature signal;

d) temperature fluctuation detecting means connected to the temperature sensing means for receiving the temperature signal from the temperature sensing means, the temperature fluctuation detecting means generating a temperature fluctuation signal when detecting a temperature fluctuation signal when detecting a temperature fluctuation in which the temperature sensed by the temperature sensing means rises and falls for a short period of time;

e) control means connected to the temperature fluctuation detecting means for controlling an operation of the magnetron in response to the temperature fluctuation signal; and f) wherein the temperature sensing means comprises a first temperature sensing element sensing the temperature of the atmosphere containing hot air emanating from the food being cooked and a second temperature sensing element having a thermal response different from that of the first temperature sensing element and sensing the temperature of the atmosphere containing hot air emanating from the food being cooked and the temperature fluctuation detecting means detects the temperature fluctuations on the basis of the difference between levels of temperature signals generated by the first and second temperature sensing element respectively.

4. A microwave oven according to claim 3, wherein the second temperature sensing element is covered by a cover member so that the thermal responsibility thereof differs from that of the first temperature sensing element.

5. A microwave oven comprising:

a) a heating chamber in which food to be cooked is contained;

b) a magnetron for range-heating the food contained in the heating chamber;

c) a turntable mounted on an inner bottom of the heating chamber to be turned;

d) temperature sensing means for sensing the temperature of an atmosphere containing hot air emanating from the food being range-heated in the heating chamber, thereby generating a temperature signal;

e) a low-frequency component blocking circuit connected to the temperature sensing means for receiving the temperature signal, thereby preventing low frequency components contained in the temperature signal generated by the temperature sensing means from passing therethrough and allowing alternating current components to pass therethrough;

f) an amplifier circuit connected to the low-frequency component blocking circuit for amplifying the alternating current components or temperature fluctuation components of the temperature signal having passed through the low-frequency component blocking circuit;

g) a comparator circuit connected to the amplifier circuit for receiving the temperature fluctuation components amplified by the amplifier circuit, the comparator circuit detecting the temperature fluctuation in which the temperature sensed by the temperature sensing means rises and falls for a short period of time, when the level of the temperature fluctuation component exceeds a set value, thereby generating a temperature fluctuation signal or a heating interruption signal; and h) control means connected to the comparator circuit for interrupting the operation of the magnetron when receiving the heating interruption signal from the comparator circuit.

6. A microwave oven according to claim 5, wherein the control means interrupts the operation of the magnetron a predetermined period of time after receiving the heating interruption signal from the comparator circuit.

7. A microwave oven comprising:

a) a heating chamber in which food to be cooked is contained;

b) a magnetron for range-heating the food contained in the heating chamber;

c) a turntable mounted on an inner bottom of the heating chamber to be turned and turned during the range-heating with the food placed thereon;

d) temperature sensing means for sensing the temperature of an atmosphere containing hot air emanating from the food being range-heated in the heating chamber, thereby generating a temperature signal;

e) temperature fluctuation detecting circuit comprising an alternating current amplifying circuit connected to the temperature sensing means for receiving the temperature signal from the temperature sensing means, the alternating current amplifying circuit allowing only an alternating current component contained in the temperature signal to pass therethrough, and a comparator circuit connected to the alternating current amplifying circuit for receiving an amplified alternating current signal, the comparator circuit comparing the level of the amplified alternating current signal with a predetermined value, thereby detecting the temperature fluctuation in which the temperature sensed by the temperature sensing means rises and falls for a short period of time and generating a temperature fluctuation signal when the level of the amplified alternating current signal is high than the predetermined value; an f) control means connected to the comparator circuit for receiving the temperature fluctuation signal from the comparator circuit, the control means determining that the heating by the magnetron should be completed, thereby interrupting the operation of the magnetron, when receiving the temperature fluctuation signal from the comparator circuit.

8. A microwave oven comprising:

a) a heating chamber for accommodating food to be cooked;

b) a magnetron for supplying microwaves into the heating chamber, thereby range-heating the food;

c) temperature sensing means for sensing the temperature of an atmosphere containing hot air emanating from the food being range-heated, thereby generating a temperature signal;

d) a low frequency component blocking circuit connected to the temperature sensing means for preventing a low frequency component contained in the temperature signal generated by the temperature sensing means from passing therethrough and for allowing a temperature signal to pass therethrough;

e) an amplifier circuit connected to the low-frequency component blocking circuit for amplifying the temperature fluctuation component of the temperature signal having passed through the low frequency component blocking circuit;

f) a comparator circuit connected to the amplifier circuit for receiving the temperature fluctuation component amplified by the amplifier circuit, the comparator circuit generating a temperature fluctuation detection signal when the temperature fluctuation component amplified by the amplifier circuit exceeds a predetermined value; and g) control means connected to the comparator circuit, responsive to the temperature fluctuation signal, for determining that the temperature fluctuation has reached a predetermined level when a pulse width of the temperature fluctuation signal exceeds a predetermined period and for controlling the operation of the magnetron on the basis of a result of the determination.

* * * * *